455 - 603

United States Patent [19]

Ishimoto

[11] Patent Number: 4,563,162

[45] Date of Patent: Jan. 7, 1986

[54] TOY CAR REMOTELY CONTROLLABLE BY FIBER OPTIC MEANS

[75] Inventor: Zenichi Ishimoto, Tokyo, Japan

[73] Assignee: Nikko Co., Ltd., Tokyo, Japan

[21] Appl. No.: 531,818

[22] Filed: Sep. 13, 1983

[30] Foreign Application Priority Data

Apr. 5, 1983 [JP] Japan ..... 58-49679[U]

[51] Int. Cl.[4] ..... A63H 30/00; A63H 17/36; A63H 33/26

[52] U.S. Cl. ..... 446/175; 455/603; 446/438; 446/454; 446/460; 446/485

[58] Field of Search ..... 446/30, 33, 175, 454, 446/455; 350/96.1; 455/603

[56] References Cited

U.S. PATENT DOCUMENTS

| | | | |
|---|---|---|---|
| 3,406,481 | 10/1968 | Tachi | 455/603 X |
| 3,722,135 | 3/1973 | Jacobson | 446/454 X |
| 3,943,357 | 3/1976 | Culver | 455/603 |
| 4,201,012 | 5/1980 | Marshall | 446/175 |
| 4,306,314 | 12/1981 | Griffiths | 455/603 |

*Primary Examiner*—F. Barry Shay

[57] ABSTRACT

A remote-controllable toy car is disclosed in which a car body is connected to an operating device through a single or a plurality of optical fibers. The toy car may be controlled in a simple optical communication system and is suitable for a small child.

8 Claims, 5 Drawing Figures

TOY CAR REMOTELY CONTROLLABLE BY FIBER OPTIC MEANS

FIELD OF THE INVENTION

This invention relates to an electrically driven toy car of a remote-controllable type, more particularly to a remote-controllable toy car using for improved operation fiber optics as a signal transmitting means between a toy car body and an operating device.

BACKGROUND OF THE INVENTION

Recently, an electrically driven toy car of a remote-controllable type has become popular, in which the toy car body is separate from an operating device, a wireless transmitting system or the car body being connected to the operating device through a conductive wire. Since the former type of the toy car, using the wireless transmitting system allows the car body to freely move in any direction, a high degree of operational skill is needed, making it unsuitable for use by a small child. The latter type of the toy car, on the other hand, is simple in construction and operation, limited in its movable range and may be produced at low cost, and most significantly is suitable for use by a small child.

The toy car using the conductive wire scheme for connecting the car body to the operating device is limited to forward and backward movement of the car body through reversible polarization of an armature by means of a power controlling switch of the operating device. In order to provide such toy car with a direction-changing function, an additional specific wire must be arranged leading to a complicated construction and a larger size of the conductive wire. Further, since such type of the toy car usually utilizes a plastic coated wire as the conductive wire for connecting the car body to the operating device, the plastic coating material may deteriorate or harden at low temperatures leading to breakage of the wire or difficulty in operating the toy car. To make matters worse, the plastic coated wire requires sufficient strength to resist a pulling force of the car body, resulting in a relatively large diameter and bulky of the wire which increases the hardening phenomenon at low temperatures and adversely affect the operation of the toy car.

SUMMARY OF THE INVENTION

A general object of the invention is to provide a remote-controllable toy car which is characterized by simple multi-functional and excellent operability ensured by use of fiber optics of very small diameter yet of satisfactory strength and excellent signal transmitting performance for connecting the car body to the operating device in an optical communication system.

A principal object of the invention is to provide a remote-controllable toy car, which comprises a car body having a driving means, a steering control means and a controller for said means as well as an operating device provided with a control means for performing ON-OFF operation of a power source and switching operation, said car body being connected to said operating device through fiber optics which transmit control signals from said control means of the operating device to said controller of the car body in an optical communication system.

PREFERRED EMBODIMENTS OF THE INVENTION

In accordance with the invention, we provide a remote-controllable toy for a small child, which is multi-functional, of simple operation, excellent durability and low producton cost realized by connecting the car body to the operating device through a single or a plurality of optical fibers and transmitting signals in a simple optical communication system.

In the remote-controllable toy car according to the invention, preferably the car body is connected to the operating device through two optical fibers, each of which receives and transmits optical signals for driving the car body and for controlling the steering operation. In this case, the control means of the operating device comprises a power source, two lamps and two switches, said switches being controlled for selectively or simultaneously turning said lamps ON-OFF.

Further, the car body may be connected to the operating device through a single optical fiber for controlling a reversible drive of the car body.

Alternatively, the car body may be connected to the operating device through more than two optical fibers for controlling both the reversible drive and the change-over of the steering of the car body.

The invention will be described in more detail for the preferred embodiments with reference to the accompanying drawings.

BRIEF DESCRIPTION OF THE DRAWINGS

Referring to FIG. 1, there is shown a schematic illustration of a toy car according to the invention, wherein a car body 10 is connected to an operating device 12 through fiber optics 14.

FIG. 2 shows a control system for the toy car of FIG. 1, wherein the operating device 12 includes a power source 16 and two change-over switches 18, 10 as well as a first and a second lamps 22, 24 operable through the switches 18, 20. A portion of the operating device 12 thus constructed is fixed to one end of a pair of optical fibers 14*a*, 14*b* which at their optical inlet terminals are confronted with the first and the second lamps 22, 24. On the other hand, the car body 10 includes a power source 26, a steering control means 28, a driving motor 30 and a controller 32 for controlling the steering control means 28 and the driving motor 30 as well as a first and a seccond photoelectric converters 34, 36. A portion of the car body 10 thus constructed is fixed to the other end of the pair of optical fibers 14*a*, 14*b* which at their optical outlet terminals are confronted with the first and the second photoelectric converters 34, 36. In the car body 10, the steering control means 28 is provided at front wheels for controlling straight movement and turning movement to the right or the left through a combination of two signals from the controller 32. Further, the driving motor 30 is provided at rear wheels for controlling their normal, or forward driving, through a signal from the controller 32.

FIG. 3 shows one embodiment of a steering control means 28 of the type disclosed in my U.S. Pat. No. 4,471,566. The steering control means is mounted to the car body 10 of the preferable toy car according to the invention wherein a reference 40 represents a front part of a car base while 42 represents wheels. A pair of wheels 42, 42 are engaged at the opposite ends of a steering plate 46 through rocking shaft bearings 44, 44. Thus, in the illustrated embodiment, movement of the steering plate 46 toward the right side allows the wheels 42, 42 to shift in the right. Under the steering plate 46 is arranged a control element 48 which at its one end is pivotted to a shaft 50 protruding from the car base 40, while opposing end carries a pair of magnets 52, 54. In opposition to the magnets 52, 54 on the control element 48, an electromagent 56 is fixed to the car base 40. Further, the control element 48 at its middle part is provided with an upward projection 48, which fits within opening 60 formed in the steering plate 46 for swingably engaging the control element 48 with the steering plate 46.

Figure 1:
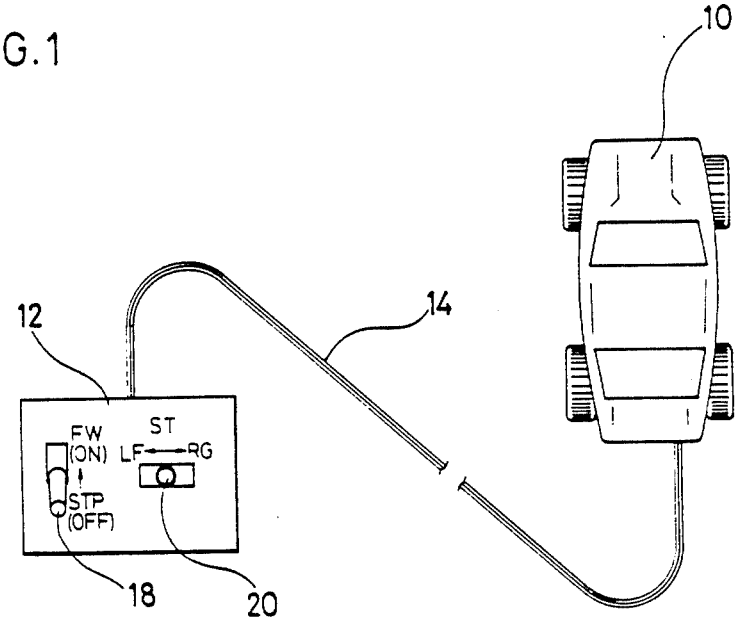
FIG. 1 is a plan view of one embodiment of the remote-controllable toy car according to the invention.

The electromagnet 56 is comprised of a double coil to be differently polarized, while the pair of magnets 52, 54 opposite to the electromagnet 56 have also different polarities. Thus, energization of a top end of the electromagnet 56 to the N polarity allows the enabling, for example, attraction of one magnet which causes control element 48 to pivot 52 and thus shifted on the shaft 50 to the right side. Likewise, energization of the top end of the electromagnet 56 to the S polarity enables attraction of the other magnet 54 which causes the control element 48 to pivot about shaft 50 to the left side. Further, symmetrically disposed relative to shaft 50 is a pair of supporting rod 62, 64 which at their one ends are pivotally supported on the car base 40 and at their middle parts are connected elastically with a spring 66, while their swingable ends engage an actuating element (not shown) and a stop (not shown) fixed to the base extending below the control element 48 and normally at a neutral position. When the control element swings from its neutral position, the actuating element engages one or the other of the rods 62, 64 to separate the rods from their normal substantially parallel relation against the bias of spring 66 so that when the electromagnet is deenergized, the spring will return the displaced leg to the position shown, thereby positioning the wheels of the car for straight ahead driving.

In this way, according to this embodiment, the wheels 42, 42 may be turned to the right or the left by changing the energization of the electromagnet 56, while the straight movement may be retained by disenergization of the electromagnet 56.

Operation of the toy car shown in FIGS. 1 and 2 will be described hereinbelow.

At first, a power switch (not shown) is put on in the car body 10 and the operating device 12. Then the two switches 18, 20 of the operating device 12 are alternately or simultaneously operated. In this case, the forward operation of the switch 18 (ON position) and the left turning operation of the switch 20 may energize the first lamp 22 and turn it on. The light from the first lamp 22 is received by the first photoelectric converter 34 of the car body 10 through the optical fiber 14*a* for generating an input signal for the controller 32. Similarly, the forward operation of the switch 18 (ON position) and the right turning operation of the switch 20 may put the second lamp 24 on, the light from which is received by the second photoelectric converter 36 through the optical fiber 14*b* for generating another input signal for the controller 32. Further, the forward operation of the switch 18 (ON position) and the straight moving operation of the switch 20 will put both the first and the second lamps 22, 24 on, the light from which generates a further input signal for the controller 32 through the optical fibers 14*a*, 14*b* and the photoelectric converters 34, 36. The controller 32 generates control signals for the steering control means 28 and the driving motor 30 through the input signals from the photoelectric converters 34, 36. Namely, through the forward operation of the switch 18 (ON position) and the turning or straight moving operation of the switch 20 for energizing the lamp 22 and/or 24 in the operating device 12, the controller 32 of the car body 10 may generate a signal for normally rotating the driving motor 30 to move the car body 10 forward, as well as another signal for controlling the steering control means 28 to provide the left or the right turning or the straight movement.

Figure 2:
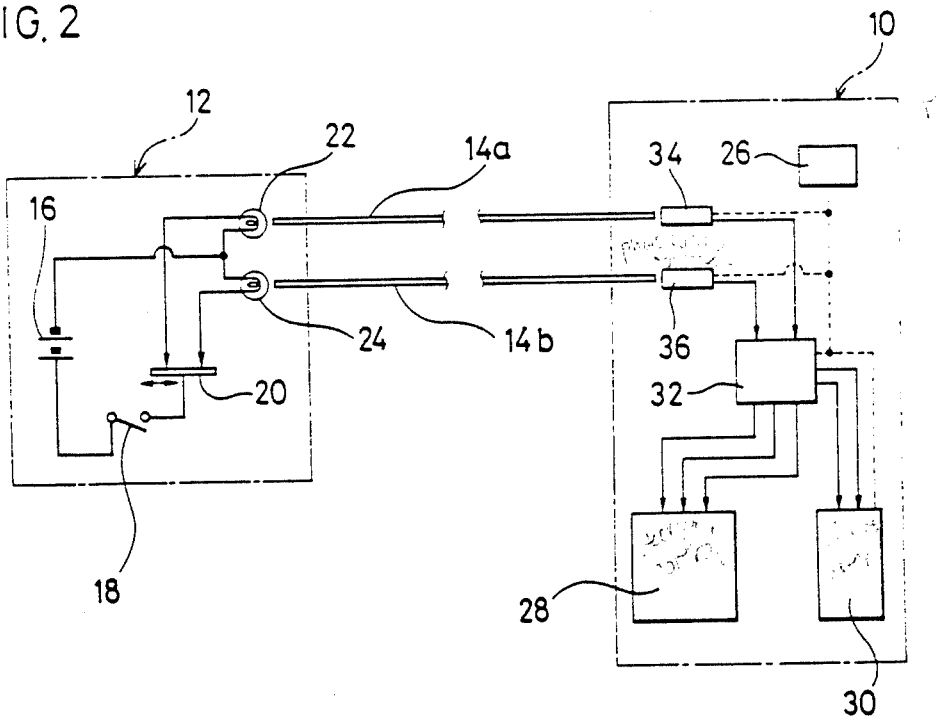
FIG. 2 is a schematic view of a control system for the toy car in FIG. 1.
Figure 3:
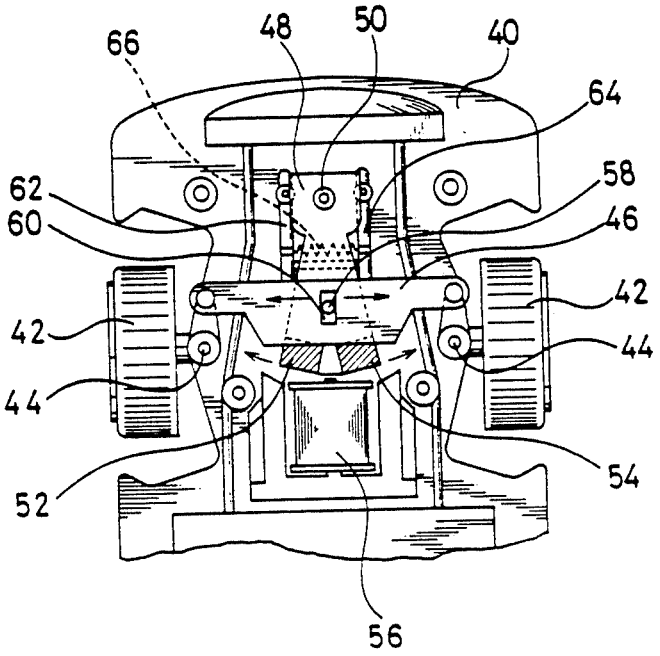
FIG. 3 is a plan view of a main portion of a steering control device applicable to a car body of the toy car in FIG. 1.
Figure 4:
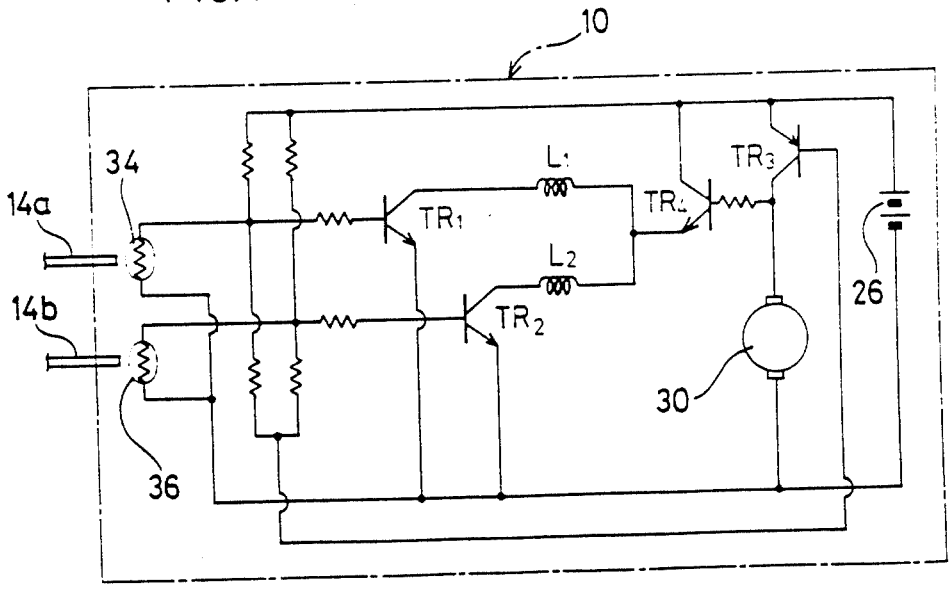
FIG. 4 shows a control circuit of the control system for the car body in FIG. 2.

According to the embodiment as previously described, a control circuit for the car body 10 of FIG. 2 is shown in FIG. 4, wherein switching transistors TR1 to TR4 are connected to each photoelectric converter 34, 36 to form the controller 32. To these transistors TR1 to TR4 are connected the driving motor 30 and coils L1, L2 through the power source 26. The coils L1, L2 are formed as coils for the electromagnet 56 energizable to different polarities. The circuit thus constructed may be accommodated in the steering control means 28.

Thus, the toy car according to this embodiment allows the driving motor 30 to be rotated or discontinued and the coils L1, L2 to be selectively or simultaneously energized for forward moving or turning the car body 10 through ON-OFF operation of the switches 18, 20 of the operating device 12 (FIG. 2) using the two optical fibers 14*a*, 14*b*. In other words, when the first or the second lamp 22, 24 is put on, the first or the second photoelectric converter 34 or 36 is in a position for receiving the light and turning on the switching transistors TR3, TR4 to drive the motor 30 thereby to move the car body 10, while the transistors TR1, TR2 corresponding to the photoelectric converter 34 or 36, which has not received the light, is turned on to selectively energize the coils L1, L2 for turning the car body 10 either to the left or the right. The switching transistor TR4 is provided for preventing energization of the coils L1, L2 upon the ON position of the switching transistor TR1 and TR2 when car operation and thus motor operation is discontinued. When both the first and the second lamps 22, 24 are simultaneously put on, the switching transistors TR1, TR2 are in the OFF position not to energize the coils L1, L2, while the switching transistors TR3, TR4 are in the ON position to drive the motor 30 for moving the car body 10 in a straight direction.

According to the previous embodiment, an additional optical fiber may be used, namely a total of three optical fibers may be utilized and a reversible motor may be used as the driving motor 30 in order to generate an operating signal for the controller 32 for the reversible driving control of the motor 30 through the additional optical fiber.

Figure 5:
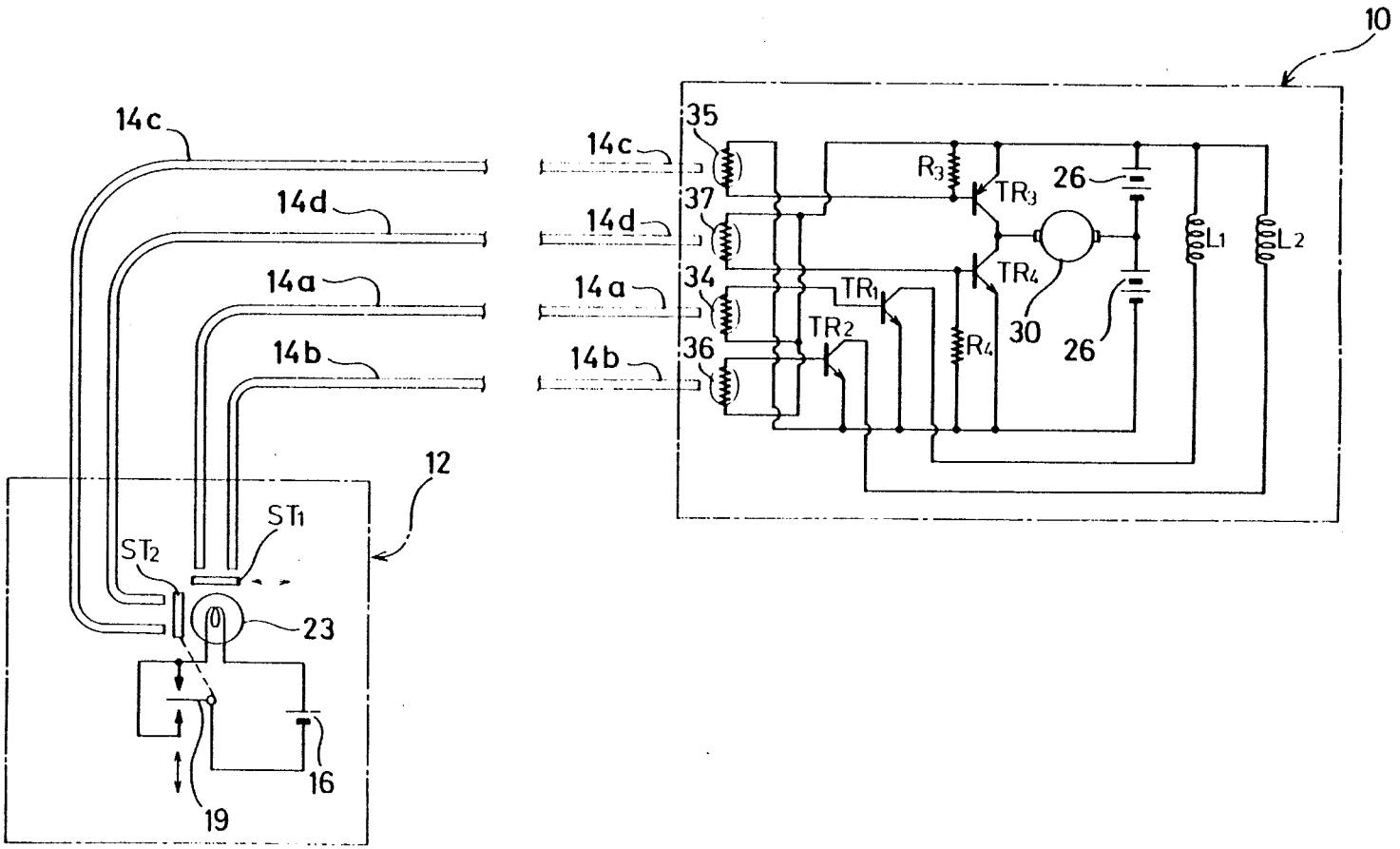
FIG. 5 shows another control circuit of another control system for the remote-controllable toy car according to the invention.

Alternatively, four optical fibers may be utilized for the reversible driving or discontinuing operation of the motor 30 and turning or straight movement of the car body 10. For this purpose, a circuit of the control system for the car body 10 and the operating device 12 is shown in FIG. 5, wherein the identical references are given for the identical components in the previous embodiment. In FIG. 5, the operating device 12 comprises the power source 16, the signal lamp 23 and the switch 19 for the lamp 23. The lamp 23 of the operating device 12 is confronted with the input terminals of two sets of optical fibers 14*a*, 14*b* and 14*c*, 14*d* through shutters ST1, ST2. Since each optical fiber is usually intercepted by the shutter ST1, ST2, either one set of optical fibers 14*a*, 14*b* or 14*c*, 14*d* may receive the light from the lamp 23 through external operation of the shutter ST1 or ST2. The shutter ST2 may be associated with the switch 19 for moving the same aside for enabling optic fibers 14*c* and 14*d* to receive light from lamp 23. On the other hand, in the car body 10, the output terminals of the optical fibers 14*a*, 14*b* and 14*c*, 14*d* are confronted with the photelectric converters 34, 36 and 35, 37 and connected to the switching transistors TR1, TR2 and TR3, TR4 of the controller, to which transistors are connected the power source 26 through the coils L1, L2 in a manner similar to the circuit showing in FIG. 4. To the switching transistors TR3, TR4 is connected the reversible driving motor 30 through the power source 26. In this way, transmission of the light to either one of the set of optical fibers 14*a*, 14*b* may selectively turn the transistor TR1 or TR2 in the ON position to energize the coils L1, L2 and to turn the car body 10 either to the right or the left, while interception of both the optical fibers 14*a*, 14*b* may turn the transistors TR1, TR2 in the OFF position to move the car body 10 straight. On the other hand, transmission of the light either one of the other set of optical fibers 14*c*, 14*d* may turn the switching transistor TR3 or TR4 in the ON position to drive the motor 30 either normally or reversely for moving the car 10 forward or backward, while interception of both the optical fibers 14*c*, 14*d* may turn transistors TR3, TR4 in the OFF position to discontinue the movement of the car body 10. Alternatively, a single optical fiber may be used in combination with a reversible driving motor for effecting forward and backward movement of the toy car, to the exclusion of car steering. In this embodiment, however, the front wheels are in the free state; i.e. they are not provided with steering control means while the rear wheels may be connected to the reversible driving motor. The toy car may thus be turned in a random direction during its backward movement.

As apparent from the foregoing, in accordance with the invention, the car body and the operating device may be interconnected through a single or a plurality of optical fibers for transmitting the control signals from the operating device to the car body and for embodying the driving and steering control by means of the simple optical communication system. Even if the long optical fiber is used for interconnection it may be shortened in length by, for example, knotting on operation. Further, the optical fiber because it has excellent flexibility, strength and durability, the toy car for small children may be economically produced.

In accordance with the invention, the switches of the operating device are of simple structure which is in the ON position only upon the contact operation, while the lamp of the luminous diode type is utilized as the light source, resulting in a small, light weight and low power-consuming toy car suitable for the small child. Especially by using a single optical fiber, there is obtained a toy car of easy operation and low cost, suitable for use by the small child.

The toy car according to the invention is widely applicable not only to a toy bicycle, a tricycle and an automobile but also to toy ships.

Although the invention has been described with the preferred embodiments, many modifications and variations may be made without departing from the spirit and the scope of the invention.

What is claimed is:

1. A remote-controllable toy car which comprises a car body and an operating device spacially separated from the car body and comprising lamp means for emitting a light beam when energized, and means for passing or blocking the light beam in a selectable sequence thereby to provide optical ON-OFF signals in the selected sequence, fiber optic means for optically interconnecting said operating device with said vehicle body, said body containing photo-electric converter means for converting said optical ON-OFF signals into electrical ON-OFF signals supplied to an output thereof, said optical fiber means being in confronting relation to said blocking means and said photo-electric converter means whereby to sense the optical ON-OFF signals for transmission by said optical fiber means to said photo-electric converter means, and circuit means in said vehicle body having input means supplied from the output of said photo-electric converter means for controlling diverse movements of said vehicle body as a function of the ON-OFF signals sensed by the photo-electric converter means.

2. The toy car of claim 1, wherein said car body has controlling means for driving and steering operation and a controller for controlling said controlling means, said operating device being manually operable and having a control means comprising a power source, switch means and said lamp means connected in a circuit for controlling passage of light from said lamp means, said controller of the car body being mechanically and optically connected through said control means of the operating device by said fiber optic means through which the light of the lamp means in form of said optical ON-OFF signals produced in the operating device are transmitted to the controller of the car body.

3. The toy car of claim 2, wherein two optical fibers are used to optically interconnect and communicate the car body with the remote operating device, either one or both of the optical fibers receiving and transmitting the optical ON-OFF signals for controlling the driving and steering operation of the car body.

4. The toy car of claim 3, wherein the control means of the operating device comprises two lamps and two switches, said switches being operated for simultaneously turning said lamps on or off.

5. The toy car of claim 3, wherein the control means of the operating device comprises two lamps and two switches, said switches being operated for selectively turning said lamps on and off.

6. The toy car of claim 5, wherein said controller includes a control circuit having input means connected to said photo-electric converter means, said control circuit including two coils of an electromagnet and a driving motor for the toy car, a pivotally mounted control element in the toy car having permanent magnets at its free end in confronting relation to the electromagnet, front wheels of the car being turnable for turning in a given direction governed by pivotal movement of said control element as a function of the state of energization of the coils of the electromagnet which in turn is a function of said input to said input means, the driving motor likewise being energized as a function of the input to the input means.

7. The toy car of claim 2, wherein a single optical fiber is used to connect and communicate the car body with the operating device for controlling reversible drive of the car body to the exclusion of steering.

8. The toy car of claim 2, wherein at least three optical fibers are used to optically interconnect and communicate the car body with the operating device for controlling both reversible drive and selectable steering.

* * * * *